US009816352B2

(12) United States Patent
Pickle et al.

(10) Patent No.: US 9,816,352 B2
(45) Date of Patent: Nov. 14, 2017

(54) TUBING PRESSURE OPERATED DOWNHOLE FLUID FLOW CONTROL SYSTEM

(71) Applicant: Halliburton Energy Services, Inc., Houston, TX (US)

(72) Inventors: Brad R. Pickle, Frisco, TX (US); Michael Fripp, Carrollton, TX (US)

(73) Assignee: HALLIBURTON ENERGY SERVICES, INC, Houston, TX (US)

( * ) Notice: Subject to any disclaimer, the term of this patent is extended or adjusted under 35 U.S.C. 154(b) by 0 days.

(21) Appl. No.: 14/768,297

(22) PCT Filed: Mar. 21, 2013

(86) PCT No.: PCT/US2013/033364

§ 371 (c)(1),
(2) Date: Aug. 17, 2015

(87) PCT Pub. No.: WO2014/149049

PCT Pub. Date: Sep. 25, 2014

(65) Prior Publication Data

US 2016/0003005 A1 Jan. 7, 2016

(51) Int. Cl.
*E21B 34/14* (2006.01)
*E21B 34/10* (2006.01)
(Continued)

(52) U.S. Cl.
CPC ..... *E21B 34/14* (2013.01); *E21B 34/10* (2013.01); *E21B 34/102* (2013.01); *E21B 43/12* (2013.01); *E21B 43/14* (2013.01)

(58) Field of Classification Search
CPC ..... E21B 34/10; E21B 34/14; E21B 43/10; E21B 43/12
See application file for complete search history.

(56) References Cited

U.S. PATENT DOCUMENTS 3,722,527 A 3/1973 Blackwell
4,224,993 A 9/1980 Huckaby
(Continued)

FOREIGN PATENT DOCUMENTS

CN 101709793 A 5/2010
GB 2315082 A 1/1998

OTHER PUBLICATIONS

International Search Report and The Written Opinion of the International Searching Authority, or the Declaration, Nov. 27, 2013, PCT/US2013/033364, 12 pages, ISA/KR.
(Continued)

*Primary Examiner* — Matthew R Buck
*Assistant Examiner* — Aaron Lembo

(57) ABSTRACT

A downhole flow control system utilizes a tubing pressure operated valve to selectively open and close fluid flow across the system. The tubing pressure operated valve includes a piston responsive to tubing pressure, and a valve element responsive to piston movement. The valve element can be moved rotationally, longitudinally, or both, in response to the piston movement. The valve is movable between a closed and at least one open position. The piston and valve elements can be releasably attachable, such as by a one-way ratchet. The valve element can be a rotating valve operable by a J-slot mechanism to rotate to multiple positions in response to movement of the piston element.

27 Claims, 11 Drawing Sheets

(51) Int. Cl.
*E21B 43/12* (2006.01)
*E21B 43/14* (2006.01)

(56) References Cited

U.S. PATENT DOCUMENTS

| | | | | |
|---|---|---|---|---|
| 5,335,731 | A * | 8/1994 | Ringgenberg | E21B 23/006 166/264 |
| 6,109,354 | A | 8/2000 | Ringgenberg et al. | |
| 6,220,357 | B1 | 4/2001 | Carmichael et al. | |
| 6,659,186 | B2 * | 12/2003 | Patel | E21B 23/006 166/332.2 |
| 7,055,598 | B2 | 6/2006 | Ross et al. | |
| 7,124,824 | B2 * | 10/2006 | Turner | E21B 43/08 166/329 |
| 7,296,633 | B2 * | 11/2007 | Bode | E21B 34/08 166/334.1 |
| 8,646,537 | B2 * | 2/2014 | Tips | E21B 33/128 166/179 |
| 8,978,773 | B2 * | 3/2015 | Tilley | E21B 34/14 166/194 |
| 9,187,991 | B2 * | 11/2015 | Fripp | E21B 43/12 |
| 2002/0046845 | A1 | 4/2002 | Rayssiguier et al. | |
| 2004/0163815 | A1 | 8/2004 | Vann | |
| 2009/0065199 | A1 | 3/2009 | Patel et al. | |
| 2009/0078428 | A1 | 3/2009 | Ali | |
| 2009/0084556 | A1 * | 4/2009 | Richards | E21B 43/086 166/329 |
| 2009/0151925 | A1 | 6/2009 | Richards et al. | |
| 2009/0194289 | A1 | 8/2009 | Clem | |
| 2009/0272544 | A1 | 11/2009 | Giroux et al. | |
| 2010/0139923 | A1 | 6/2010 | Biddick | |
| 2011/0030969 | A1 | 2/2011 | Richards | |
| 2011/0198097 | A1 * | 8/2011 | Moen | E21B 34/08 166/373 |
| 2011/0253391 | A1 | 10/2011 | Veit et al. | |
| 2012/0048561 | A1 * | 3/2012 | Holderman | E21B 43/12 166/316 |
| 2012/0199363 | A1 | 8/2012 | Hu | |
| 2013/0014959 | A1 * | 1/2013 | Tips | E21B 33/128 166/387 |
| 2013/0048290 | A1 * | 2/2013 | Howell | E21B 34/08 166/305.1 |
| 2013/0264051 | A1 * | 10/2013 | Kyle | E21B 41/00 166/244.1 |
| 2013/0343918 | A1 * | 12/2013 | Fripp | F04B 17/042 417/53 |
| 2014/0048282 | A1 * | 2/2014 | Dykstra | E21B 34/08 166/373 |
| 2015/0027735 | A1 * | 1/2015 | Murphree | E21B 34/066 166/381 |
| 2016/0194938 | A1 * | 7/2016 | Fripp | E21B 33/1285 166/244.1 |

OTHER PUBLICATIONS

Intellectual Property Office of Singapore, Search Report and Written Opinion, Invitation to Respond to Written Opinion, Aug. 10, 2016, 190 pages, Singapore.

Canadian Intellectual Property Office, Office Action, dated Aug. 1, 2016, 5 pages, Canada.

European Patent Office, Supplementary European Search Report, dated Oct. 25, 2016, 9 pages, Europe.

The State Intellectual Property Office of the People's Republic of China, The First Office Action, dated Nov. 18, 2016. 10 pages, China.

* cited by examiner

TUBING PRESSURE OPERATED DOWNHOLE FLUID FLOW CONTROL SYSTEM

The present application is a U.S. National Stage patent application of International Patent Application No. PCT/US2013/033364, filed on Mar. 21, 2013, the benefit of which is claimed and the disclosure of which is incorporated herein by reference in its entirety.

CROSS-REFERENCE TO RELATED APPLICATIONS

None.

FIELD OF INVENTION

This invention relates, in general, to equipment utilized in conjunction with operations performed in subterranean wells and, in particular, to a downhole fluid flow control system and method utilizing tubing pressure to actuate flow control devices downhole.

BACKGROUND OF INVENTION

Without limiting the scope of the present invention, its background will be described with reference to producing fluid from a hydrocarbon bearing subterranean formation, as an example. During the completion of a well that traverses a hydrocarbon bearing subterranean formation, production tubing and various completion equipment are installed in the well to enable safe and efficient production of the formation fluids. For example, to prevent the production of particulate material from an unconsolidated or loosely consolidated subterranean formation, certain completions include one or more sand control screen assemblies positioned proximate the desired production interval or intervals. In other completions, to control the flow rate of production fluids into the production tubing, it is common practice to install one or more flow control devices within the tubing string.

Attempts have been made to utilize fluid flow control devices within completions requiring sand control. For example, in certain sand control screen assemblies, after production fluids flow through the filter medium, the fluids are directed into a flow control section. The flow control section may include one or more flow control components such as flow tubes, nozzles, labyrinths or the like. Typically, the production flow resistance or flow rate through flow control screens is fixed prior to installation.

It has been found, however, that due to changes in formation pressure and changes in formation fluid composition over the life of the well, it may be desirable to adjust the flow control characteristics of the inflow control devices. In addition, for certain completions, it would be desirable to adjust the flow control characteristics of the inflow control devices without the requirement for well intervention.

Accordingly, a need has arisen for a downhole fluid flow control system that is operable to control the inflow of formation fluids. In addition, a need has arisen for such downhole inflow control devices that may be incorporated into a flow control screen. Further, a need has arisen for such downhole inflow control devices that are operable to adjust flow characteristics without the requirement for well intervention as the production profile of the well changes over time.

SUMMARY OF THE INVENTION

A downhole flow control system utilizes a tubing pressure operated valve to selectively open and close fluid flow across the system. The tubing pressure operated valve includes a piston responsive to tubing pressure, and a valve element responsive to piston movement. The valve element can be moved rotationally, longitudinally, or both, in response to the piston movement. The valve is movable between a closed and at least one open position. The piston and valve elements can be releasably attachable, such as by a one-way ratchet. The valve element can be a rotating valve operable by a J-slot mechanism to rotate to multiple positions in response to movement of the piston element. Further elements of the device can include temporary holding mechanisms, such as a collet assembly, shear pins and the like. The rotatable valve element can rotate endlessly, allowing repeated opening and closing of the valve device. The device is responsive to tubing pressure and does not require well intervention. The device can be used in conjunction with a sand control screen assembly, additional flow control assemblies, etc.

BRIEF DESCRIPTION OF THE DRAWINGS

For a more complete understanding of the features and advantages of the present invention, reference is now made to the detailed description of the invention along with the accompanying Figures in which corresponding numerals in the different Figures refer to corresponding parts and in which.

It should be understood by those skilled in the art that the use of directional terms such as above, below, upper, lower, upward, downward and the like are used in relation to the illustrative embodiments as they are depicted in the Figures, the upward direction being toward the top of the corresponding Figure and the downward direction being toward the bottom of the corresponding Figure. Where this is not the case and a term is being used to indicate a required orientation, the Specification will state or make such clear.

DETAILED DESCRIPTION OF PREFERRED EMBODIMENTS

While the making and using of various embodiments of the present invention are discussed in detail below, it should be appreciated that the present invention provides many applicable inventive concepts which can be embodied in a wide variety of specific contexts. The specific embodiments discussed herein are merely illustrative of specific ways to make and use the invention, and do not delimit the scope of the present invention.

Figure 1:
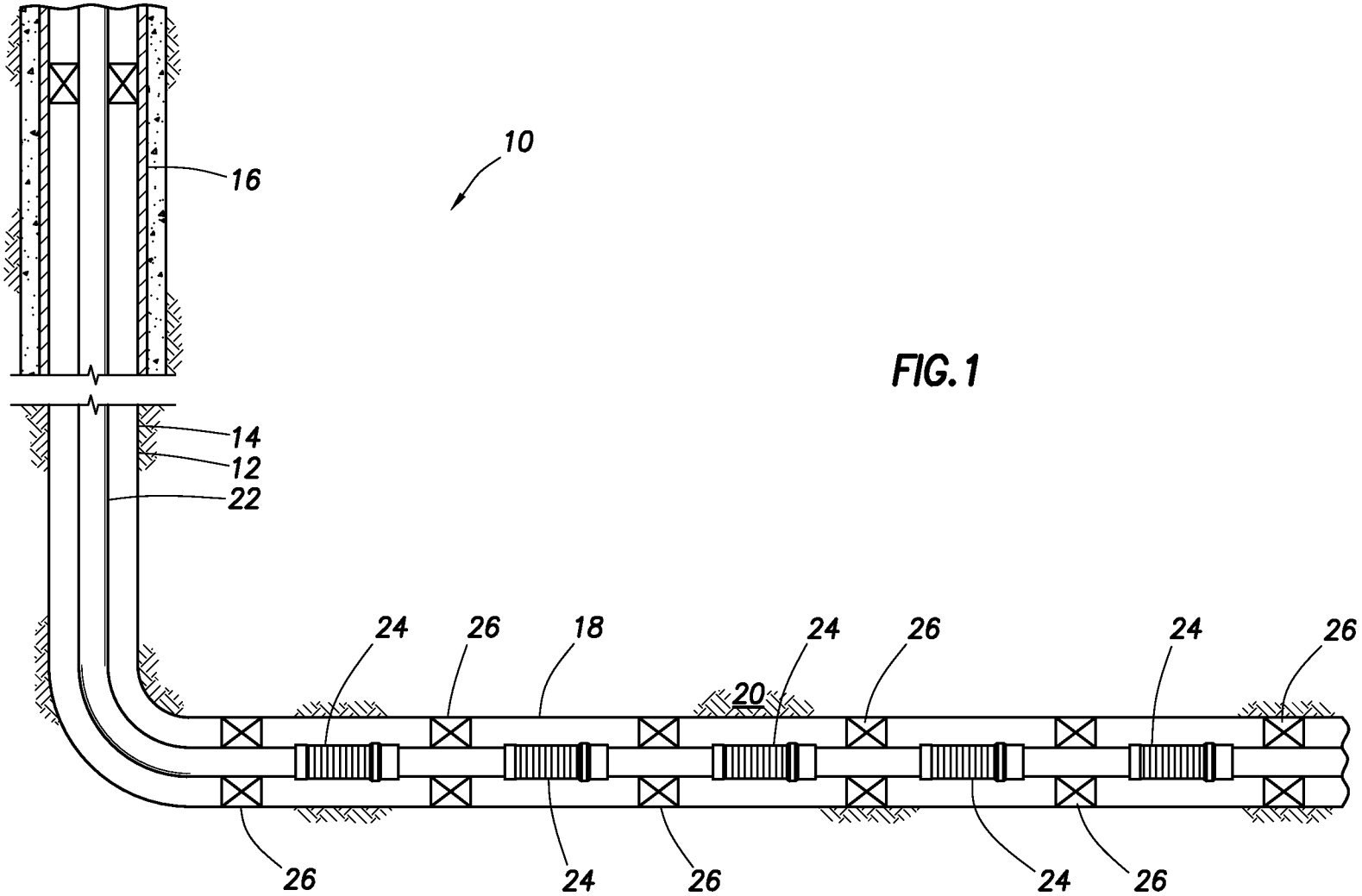
FIG. 1 is a schematic illustration of a well system operating a plurality of downhole inflow control devices according to an embodiment of the present invention.

Referring to FIG. 1, a well system is depicted having a plurality of downhole fluid flow control systems positioned in flow control screens embodying principles of the present invention, generally designated 10. In the illustrated embodiment, a wellbore 12 extends through the various earth strata. Wellbore 12 has a substantially vertical section 14, the upper portion of which has cemented therein a casing string 16. Wellbore 12 also has a substantially horizontal section 18 that extends through a hydrocarbon bearing subterranean formation 20. As illustrated, substantially horizontal section 18 of wellbore 12 is open hole.

Positioned within wellbore 12 and extending from the surface is a tubing string 22. Tubing string 22 provides a conduit for formation fluids to travel from formation 20 to the surface and for injection fluids to travel from the surface to formation 20. At its lower end, tubing string 22 is coupled to a completions string that has been installed in wellbore 12 and divides the completion interval into various production intervals adjacent to formation 20. The completion string includes a plurality of flow control screens 24, each of which is positioned between a pair of annular barriers depicted as packers 26 that provides a fluid seal between the completion string and wellbore 12, thereby defining the production intervals. In the illustrated embodiment, flow control screens 24 serve the function of filtering particulate matter out of the production fluid stream. Each flow control screen 24 also has a flow control section that is operable to control fluid flow therethrough. For example, the flow control sections may be operable to control flow of a production fluid stream during the production phase of well operations. Alternatively or additionally, the flow control sections may be operable to control the flow of an injection fluid stream during a treatment phase of well operations. As explained in greater detail below, the flow control sections are operable to control the inflow of production fluids without the requirement for well intervention over the life of the well as the formation pressure decreases to maximize production of a desired fluid such as oil. Additionally, the system utilizes the operator-controlled, tubing-pressure actuated inflow control devices as disclosed herein. That is, the system can use operator controlled inflow control devices alone or in conjunction with autonomous flow control systems. Where the two are used in conjunction, the flow characteristics of the production string will autonomously change in response to changes in fluid characteristics, but the operator can still open, close, and regulate inflow using tubing pressure changes.

Even though FIG. 1 depicts the flow control screens of the present invention in an open hole environment, it should be understood by those skilled in the art that the present invention is equally well suited for use in cased wells. Also, even though FIG. 1 depicts one flow control screen in each production interval, it should be understood by those skilled in the art that any number of flow control screens of the present invention may be deployed within a production interval or within a completion interval that does not include production intervals without departing from the principles of the present invention. In addition, even though FIG. 1 depicts the flow control screens of the present invention in a horizontal section of the wellbore, it should be understood by those skilled in the art that the present invention is equally well suited for use in wells having other directional configurations including vertical wells, deviated wells, slanted wells, multilateral wells and the like. Accordingly, it should be understood by those skilled in the art that the use of directional terms such as above, below, upper, lower, upward, downward, left, right, uphole, downhole and the like are used in relation to the illustrative embodiments as they are depicted in the Figures, the upward direction being toward the top of the corresponding Figure and the downward direction being toward the bottom of the corresponding Figure, the uphole direction being toward the surface of the well and the downhole direction being toward the toe of the well. Further, even though FIG. 1 depicts the operator controlled inflow control devices in a flow control screen, it should be understood by those skilled in the art that the operator controlled inflow control devices of the present invention need not be associated with a flow control screen or be part of a completion string. For example, the operator controlled inflow control devices may be operably disposed within a drill string for drill stem testing, within an injection string for well treatment, etc.

Figure 2A:
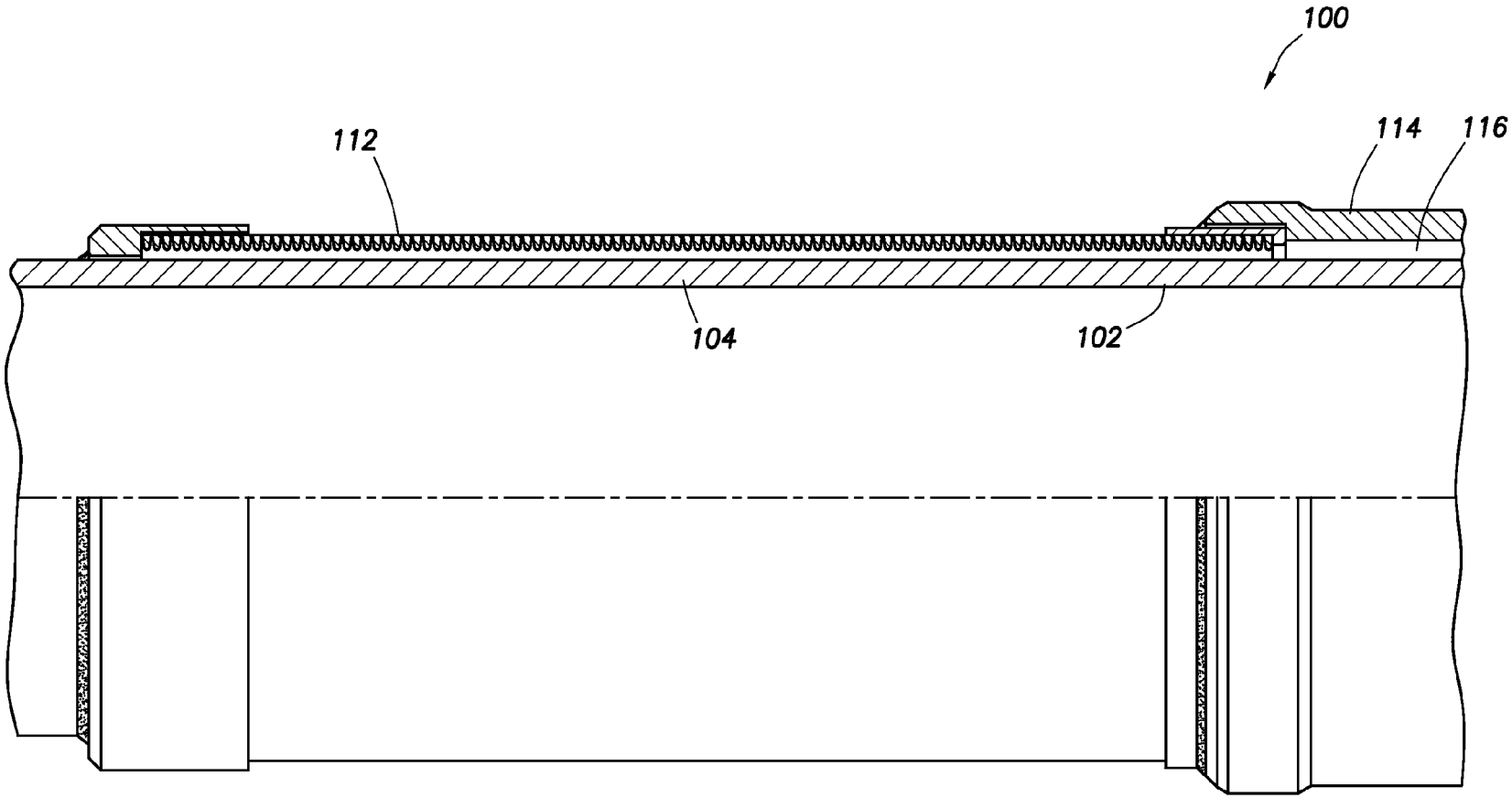
FIGS. 2A-2B are quarter sectional views of successive axial sections of a downhole inflow control devices embodied in a flow control screen of the present invention in a first configuration.
Figure 2B:
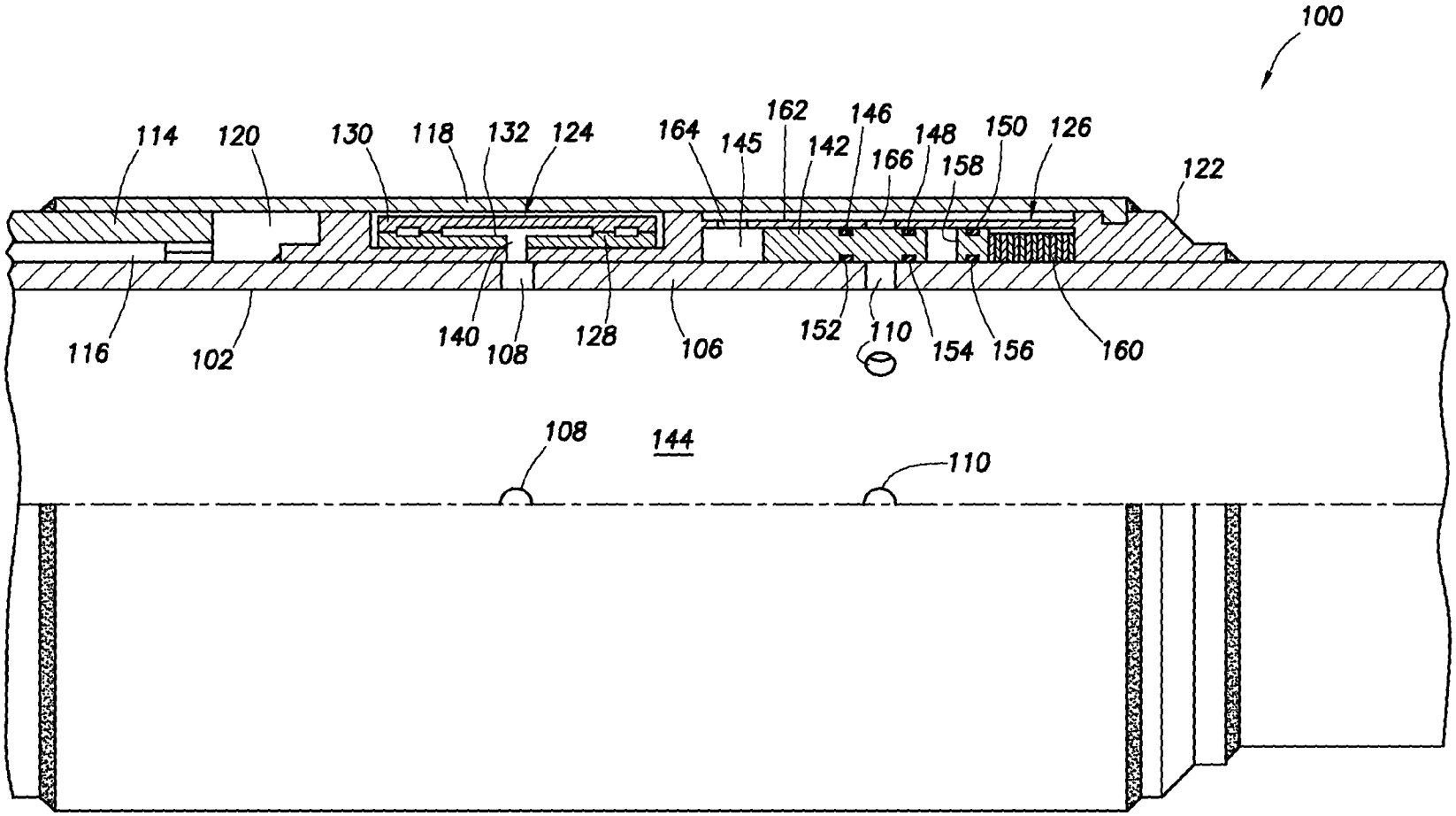

Referring next to FIGS. 2A-2B, therein is depicted successive axial sections of a flow control screen according to the present invention that is representatively illustrated and generally designated 100. Flow control screen 100 may be suitably coupled to other similar flow control screens, production packers, locating nipples, production tubulars or other downhole tools to form a completions string as described above. Flow control screen 100 includes a base pipe 102 that has a blank pipe section 104 and a perforated section 106 including a plurality of production ports 108 and a plurality of bypass ports 110. Positioned 30 around an uphole portion of blank pipe section 104 is a screen element or filter medium 112, such as a wire wrap screen, a woven wire mesh screen, a pre-packed screen or the like, with or without an outer shroud positioned therearound, designed to allow fluids to flow therethrough but prevent particulate matter of a predetermined size from flowing therethrough. It will be understood, however, by those skilled in the art that the present invention does not need to have a filter medium associated therewith, accordingly, the exact design of the filter medium is not critical to the present invention.

Positioned downhole of filter medium 112 is a screen interface housing 114 that forms an annulus 116 with base pipe 102. Securably connected to the downhole end of screen interface housing 114 is a flow control housing 118 that forms an annulus 120 with base pipe 102. At its downhole end, flow control housing 118 is securably connected to a support assembly 122 which is securably coupled to base pipe 102. The various connections of the components of flow control screen 100 may be made in any suitable fashion including 10 welding, threading and the like as well as through the use of fasteners such as pins, set screws and the like.

Positioned within flow control housing 118, flow control screen 100 has a flow control section including a plurality of flow control components 124 and a bypass section 126. In the illustrated embodiment, flow control components 124 are circumferentially distributed about base pipe 102 at one hundred and twenty degree intervals such that three flow control components 124 are provided, as best seen in FIG. 3 wherein flow control housing 118 has been removed. Even though a particular arrangement of flow control components 124 has been described, it should be understood by those skilled in the art that other numbers and arrangements of flow control components 124 may be used. For example, either a greater or lesser number of circumferentially distributed flow control components 124 at uniform or non-uniform intervals may be used. Additionally or alternatively, flow control components 124 may be longitudinally distributed along base pipe 102. As illustrated, flow control components 124 are each formed from an inner flow control element 128 and an outer flow control element 130, the outer flow control element being removed 25 from one of the flow control components 124 in FIG. 3 to aid in the description of the present invention. Flow control components 124 each have a fluid flow path 132 including a pair of fluid ports 134, a vortex chamber 136 and a port 140. In addition, flow control components 124 have a plurality of fluid guides 142 in vortex chambers 136.

Flow control components 124 may be operable to control the flow of fluid in either direction therethrough and may have directional dependent flow resistance wherein production fluids may experience a greater pressure drop when passing through flow control components 124 than do injection fluids. For example, during the treatment phase of well operations, a treatment fluid may be pumped downhole from the surface in the interior passageway 144 of base pipe 102. The treatment fluid then enters the flow control components 124 through ports 140 and passes through vortex chambers 136 where the desired flow resistance is applied to the fluid flow achieving the desired pressure drop and flow rate therethrough. In the illustrated example, the treatment fluids entering vortex chamber 136 primarily travel in a radial direction within vortex chamber 136 before exiting through fluid ports 134 with little spiraling within vortex chamber 136 and without experiencing the associated frictional and centrifugal losses. Consequently, injection fluids passing through flow control components 124 encounter little resistance and pass therethrough relatively unimpeded enabling a much higher flow rate with significantly less pressure drop than in a production scenario. The fluid then travels into annular region 120 between base pipe 102 and flow control housing 118 before entering annulus 116 and passing through filter medium 112 for injection into the surrounding formation.

Likewise, during the production phase of well operations, fluid flows from the formation into the production tubing through fluid flow control system 100. The production fluid, after being filtered by filter medium 112, if present, flows into annulus 116. The fluid then travels into annular region 120 between base pipe 102 and flow control housing 118 before entering the flow control section. The fluid then enters fluid ports 134 of flow control components 124 and passes through vortex chambers 136 where the desired flow resistance is applied to the fluid flow achieving the desired pressure drop and flow rate therethrough. In the illustrated example, the production fluids entering vortex chamber 136 travel primarily in a tangentially direction and will spiral around vortex chamber 136 with the aid of fluid guides 142 before eventually exiting through ports 140. Fluid spiraling around vortex chamber 136 will suffer from frictional losses. Further, the tangential velocity produces centrifugal force that impedes radial flow. Consequently, production fluids passing through flow control components 124 encounter significant resistance. Thereafter, the fluid is discharged through openings 108 to the interior passageway 144 of base pipe 102 for production to the surface. Even though a particular flow control components 124 has been depicted and described, those skilled in the art will recognize that other flow control components having alternate designs may be used without departing from the principles of the present invention including, but not limited to, inflow control devices, fluidic devices, venturi devices, fluid diodes and the like.

For further disclosure regarding sand control screens, flow control components, and their use, see, for example, the international patent application PCT/US2012/27463, which is hereby incorporated herein in its entirety for all purposes.

In the illustrated embodiment, bypass section 126 includes a piston depicted as an annular sliding sleeve 142 that is slidably and sealingly positioned in an annular region 145 between support assembly 122 and base pipe 102. As illustrated, sliding sleeve 142 includes three outer seals 146, 148, 150 that sealingly engage an interior surface of support assembly 122 and three inner seals 152, 154, 156 that sealingly engage an exterior surface of base pipe 102. Sliding sleeve 142 also includes one or more bypass ports 158 that extend radially through sliding sleeve 142. Bypass ports 158 may be circumferentially distributed around sliding sleeve 142 and may be circumferentially aligned with one or more of bypass ports 110 of base pipe 102. Bypass ports 158 are positioned between outer seals 148, 150 and between inner seals 154, 156. Also disposed within annular region 145 is a mechanical biasing element depicted as a wave spring 160. Even though a particular mechanical biasing element is depicted, those skilled in the art will recognize that other mechanical biasing elements such as a spiral would compression spring may alternatively be used with departing from the principles of the present invention. Support assembly 122 forms an annulus 162 with flow control housing 118. Support assembly 122 includes a plurality of operating ports 164 that may be circumferentially distributed around support assembly 122 and a plurality of bypass ports 166 that may be circumferentially distributed around support assembly 122 and may be circumferentially aligned with bypass ports 158 of sliding sleeve 142.

The operation of bypass section 126 will now be described. Early in the life of the well, formation fluids enter the wellbore at the various production intervals at a relatively high pressure. As described above, flow control components 124 are used to control the pressure and flow rate of the fluids entering the completion string. At the same time, the fluid pressure from the borehole surrounding flow control screen 100 generated by formation fluids enters annulus 162 and pass through operating ports 164 to provide a pressure signal that acts on sliding sleeve 142 and compresses spring 160, as best seen in FIG. 2B. In this operating configuration, bypass ports 158 of sliding sleeve 142 are not in fluid communication with bypass ports 166 of support assembly 122 or bypass ports 110 of base pipe 102. This is considered to be the valve closed position of sliding sleeve 142, which prevents production fluid flow therethrough. As long as the formation pressure (also referred to herein as annulus pressure or wellbore annulus pressure) is sufficient to overcome the bias force of spring 160, sliding sleeve 142 will remain in the closed position. As formation pressure declines, a change occurs in the pressure signal that acts on sliding sleeve 142. When the formation pressure reaches a predetermined level, wherein the pressure signal is no longer sufficient to overcome the bias force of spring 160, sliding sleeve 142 will autonomously shift from the valve closed position to the valve open position. In this operating configuration, bypass ports 158 of sliding sleeve 142 are in fluid communication with bypass ports 166 of support assembly 122 and bypass ports 110 of base pipe 102. Formation fluids will now flow from the annulus surrounding flow control screen 100 to the interior 144 of flow control screen 100 predominantly through bypass section 126. In this configuration, the resistance to flow is significantly reduced as the formation fluids will substantially bypass the high resistance through flow control components 124. In this manner, the flow control characteristics of flow control screen 100 can be autonomously adjusted to enable enhanced production due to a reduction in the pressure drop experience by the formation fluids entering the completion string.

While autonomous flow control systems provide a critical function in controlling production fluids, it is still desirable to maintain a method and devices for operator-controlled flow control. For example, regardless of the age of the well, the changes in formation pressure, etc., the operator may elect to increase, decrease, cease or begin fluid flow (i.e., production flow). Further, operator control without well intervention is desirable to save time and cost. Consequently, herein presented are embodiments of inflow control devices, which can be used alone or in conjunction with the autonomous flow control components, and that are operator controlled. Where the inflow control devices are used in conjunction with autonomous flow control components, alterations in design may be necessary, such as placement of the autonomous elements upstream or downstream from the operator-controlled valves, use of relatively higher tubing pressures or flow rates to operate the operator-controlled valves, etc. In the embodiments disclosed, the operator controls the inflow control devices by increasing, decreasing, or cycling tubing pressures.

FIGS. 3A-E are schematic cross-sectional illustrations of an exemplary embodiment, generally designated as 200, of an inflow control device according to an aspect of the invention utilizing a stepped-flow restriction mechanism in progressive positions during use. The illustrated inflow control device is positioned about a base pipe 202 having production ports 204. Alternate numbers and arrangements of ports can be used. A screen assembly, uphole and to the left (not shown), as is known in the art and described elsewhere herein, and appropriate flow passageways, provide fluid communication between the wellbore annulus and the device, especially to the inflow control device annulus 210 defined between the device housing 212 and support assembly 216.

At its downhole end, inflow control device housing 212 is attached to a support assembly 216 which is attached to the base pipe 202, typically by welding. The support assembly 216, at generally tubular portion 218, defines an annulus 210 between the support assembly and the housing 212.

Figure 3A:
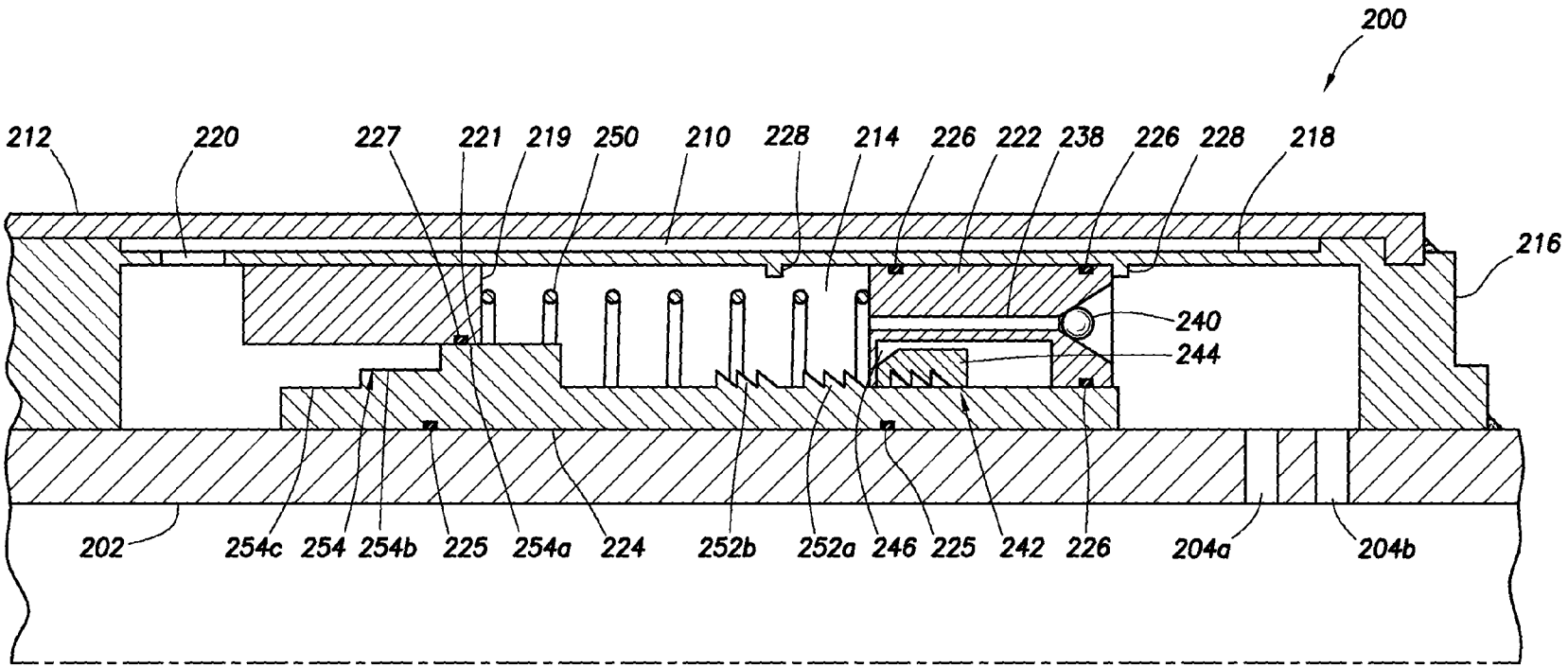
FIGS. 3A-E are schematic, cross-sectional, partial views of an exemplary embodiment of an inflow control device according to an aspect of the invention.

The inflow control device 200 includes a slidable piston 222 positioned in a valve annulus 214 defined between the tubular portion 218 of the support assembly 216 and the base pipe 202. The piston 222 can be an annular sliding sleeve, slidably and sealingly positioned in the valve annulus 214, with a plurality of check valve assemblies and ports positioned therein. Alternately, a plurality of the devices 200 can be positioned circumferentially about the base pipe, with each device having a separate piston assembly. As illustrated, the piston 222 includes seals 226 that sealingly engage an interior surface of support assembly 216 and an exterior surface of sliding flow restriction mechanism 224. Longitudinal movement of the piston 222 is limited, preferably, by stops 228. The piston is biased towards a first position, as seen in FIG. 3A, by a biasing mechanism 250, shown as a spring. Other biasing mechanisms are known in the art. The biasing mechanism 250 extends between, and is seated at either end on, a surface or shoulder of the piston 222 and an internal shoulder 219 of the support assembly 216.

The piston 222 includes one or more check valve assemblies. The check valve assembly has a bypass port 238 extending longitudinally through the piston 222, with a ball 240 sized to seat in the check valve to seal against flow in one direction, here, flow from the base pipe to the wellbore. The ball 238 can be caged. Additionally, other types of check valve or one-way valve can be employed, as known in the art.

Also disposed in or on the piston 222, is one or more ratchet mechanisms 242. The preferred ratchet mechanism includes a toothed slip member 244 captured in a slip recess 246 defined in the piston and adjacent to the flow restriction mechanism 224. The teeth of the slip member 244 cooperate with corresponding sets of teeth 252 defined on the exterior surface of the flow restriction mechanism 224. The slip member 244 can be a single annular slip or comprised of multiple slip segments arranged circumferentially around the flow restriction mechanism in corresponding slip recesses. The design and operation of slips are well known in the art. Further, the ratchet mechanism can simply employ teeth defined on the internal piston surface, or on an extension member of the piston, etc., which interact with cooperating teeth on the restriction mechanism. Ratchet mechanisms are known in the art generally and an exemplary embodiment is disclosed in the incorporated art.

A flow restriction mechanism 224 is slidably engaged in the valve annulus 214. The flow restriction mechanism is preferably a stepped sliding sleeve, as shown, having multiple positions. In FIG. 3A, the flow restriction mechanism is in a fully closed position, where fluid flow is blocked by sealing engagement between the flow restriction mechanism and a flow restriction seat 221, preferably defined by a portion of the support assembly 216. A seal 227 can be used at the surface engagement if desired and mounted to either the seat or the restriction sleeve. The flow restriction sleeve 224 includes seals 225 engaging the base pipe 202, as necessary. Defined on the exterior surface of the restriction sleeve are multiple sets of teeth 252, here two sets of teeth 252*a* and 252*b*. The sets of teeth each cooperate with corresponding teeth defined on the slip member 244. The preferred flow restrictor has a stepped flow restriction surface 254 with multiple restriction levels 254*a-c*, which, when the restriction sleeve is moved to various positions, define corresponding flow areas which allow for greater or lesser flow through the device 200.

The operation of the inflow control device 200 will now be described with reference to FIGS. 3A-E. The device is typically run-in to the hole in a first or closed position, as seen in FIG. 3A. The flow restriction sleeve 224 is in a closed position, with fluid flow through the valve annulus 214 prevented by sealing engagement between the restriction surface level 254*a* and the restriction seat 221. The piston 222 is also in a first position, maintained in position by biasing mechanism 250 and a stop 228.

Figure 3B:
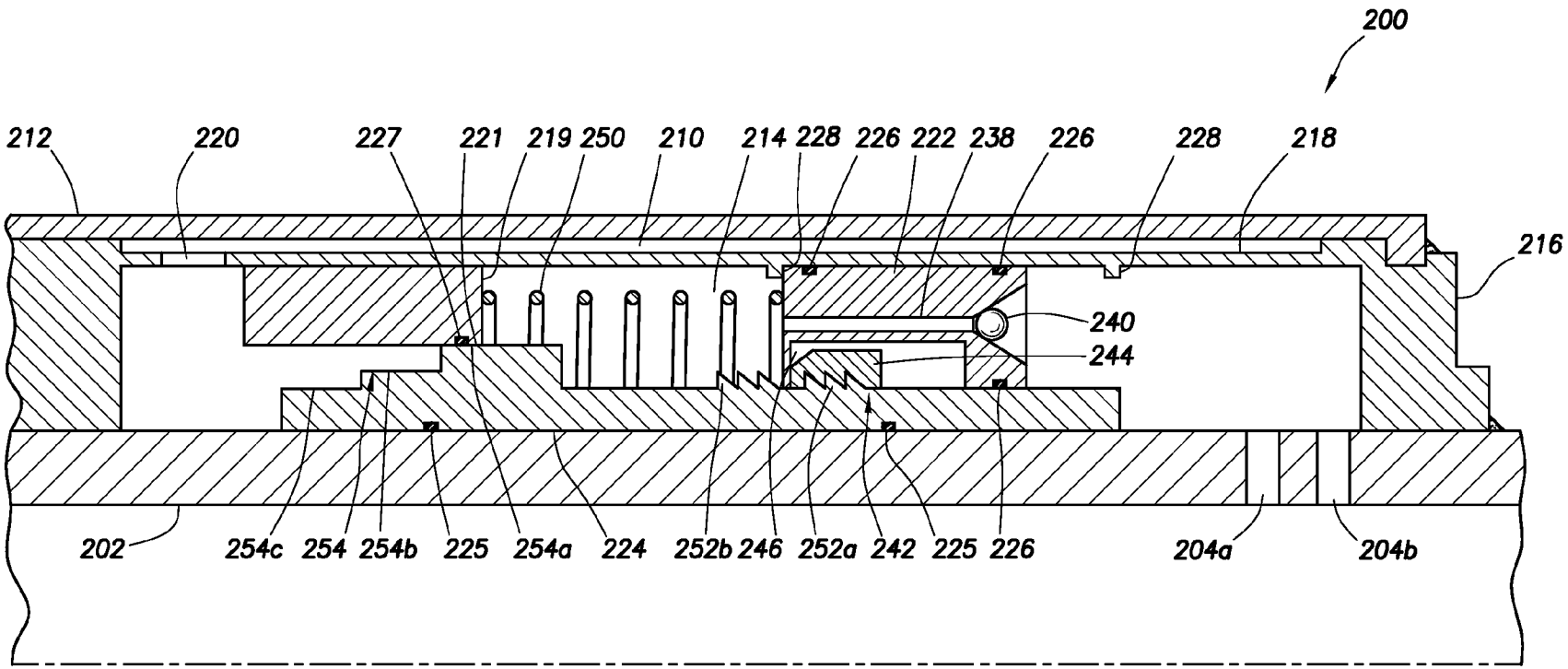

When it is desired to open the inflow control device, tubing pressure is increased by the operator, applying a differential pressure across the piston sufficient to move the piston longitudinally to a second position, as seen in FIG. 3B. The piston compresses the biasing mechanism 250 and its longitudinal movement is limited by either resistance from the biasing element or a stop 228. The ratchet mechanism 242 engages a corresponding set of teeth 252*a* defined on the flow restriction sleeve 242. More specifically, the slip segment 244 slides longitudinally over the tooth set 252*a*, utilizing, if necessary, radial space defined in the recess 246 to move radially outward to ease passage over the teeth 252*a*. Flow through the device is still blocked. Note that increased tubing pressure will operate a plurality of inflow control devices spaced longitudinally along the wellbore simultaneously.

Figure 3C:
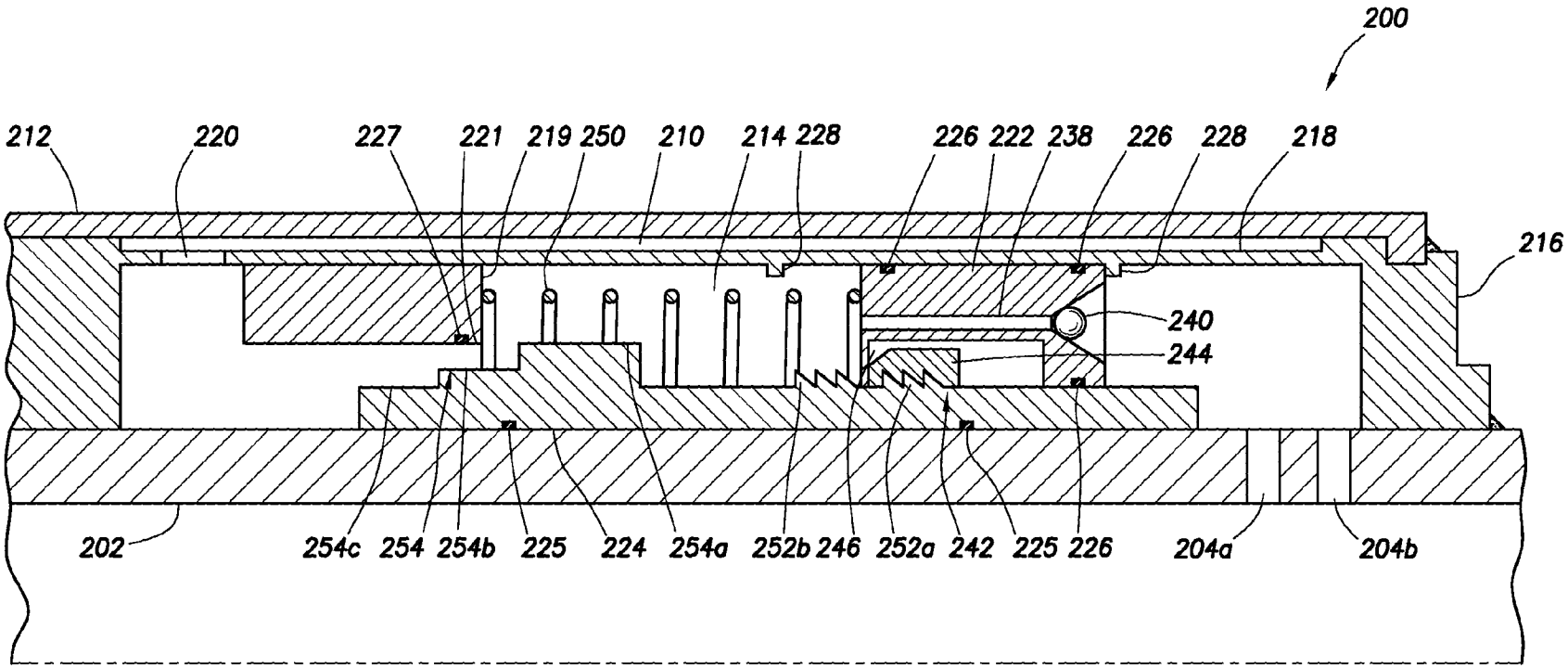

To open the inflow control device, the operator reduces tubing pressure such that the biasing mechanism 250 forces the piston 222 back to its original or first position, as seen in FIG. 3C. The flow restriction sleeve 242 is pulled by the piston since the ratchet teeth remain engaged with the tooth set 252*a* on the sleeve. The restriction sleeve 242 is moved to a second or intermediate position, as shown, allowing flow through the flow restriction assembly and across the device 200. The seat 221 and flow surface level 254*b* cooperate to define a flow area selected to allow a defined flow rate across the restriction assembly. Fluid flow is now allowed along a flow path including the wellbore annulus, a screen or filter device if present, annular area 210, support assembly port 220, across flow restriction surface 254, through check valve port 238, base pipe ports 204, and the interior passageway of the base pipe 202.

Figure 3D:
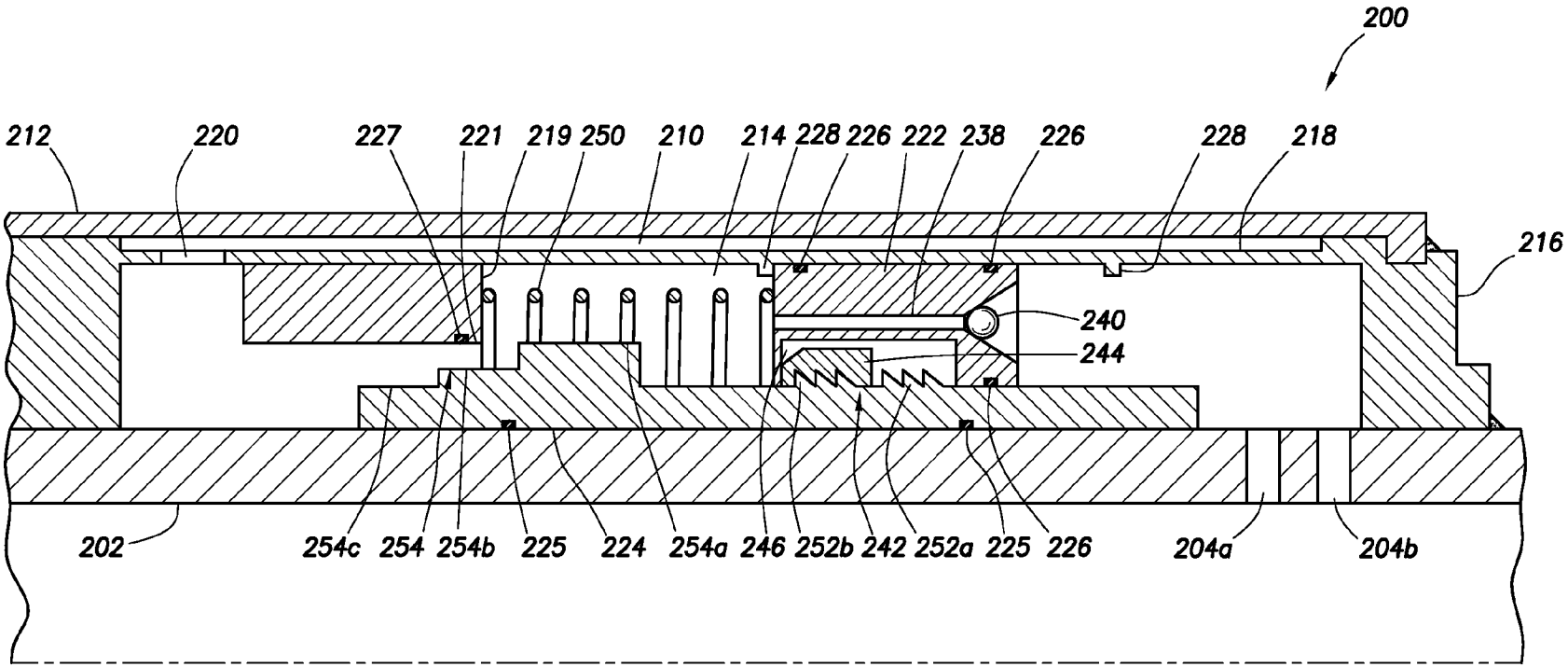
Figure 3E:
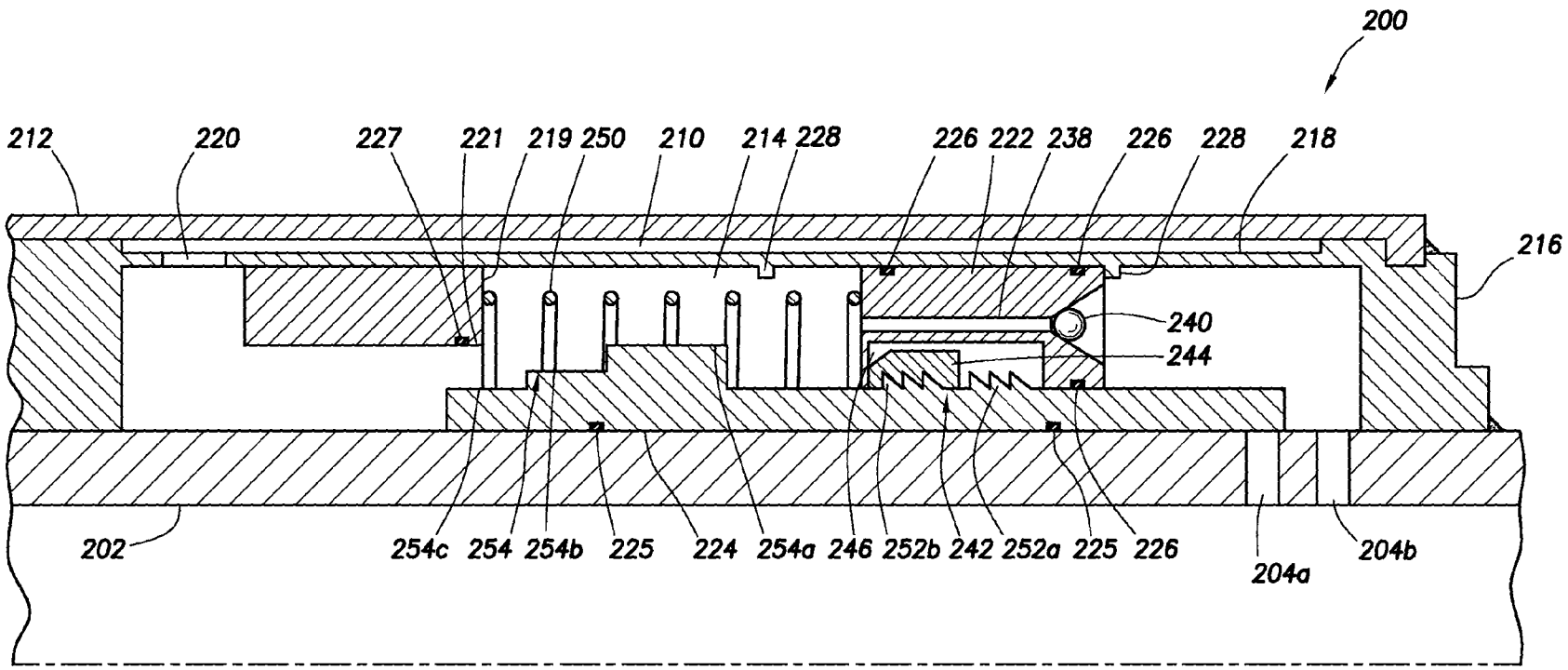

To adjust the flow restriction mechanism to a second or, in this case, final flow position, the tubing pressure is again increased, seating the check valve ball and moving the piston against the biasing element, as seen in FIG. 3D. The ratchet mechanism again cooperates, this time with tooth set 252*b*. Tubing pressure is decreased such that the biasing mechanism forces the piston 222 back to its original position, as seen in FIG. 3E. The flow restriction sleeve 242 is pulled by the piston, since the ratchet teeth remain engaged with the tooth set 252*b* on the sleeve. The restriction sleeve 242 is moved to a fully open position, as seen in FIG. 3E. Fluid flows through the flow restriction assembly and across the device 200. The seat 221 and flow surface level 254*c* cooperate to define a fully open flow area, selected to allow a defined flow rate across the restriction assembly. Fluid flows along a flow path including the wellbore annulus, a screen or filter device if present, annular area 210, support assembly port 220, across flow restriction surface 254, through check valve port 238, base pipe ports 204, and the interior passageway of the base pipe 202.

Additional restriction and flow rate gradations can be used. For example, in a stepped flow restriction mechanism, additional flow surface levels can be added, with corresponding additional teeth sets for cooperation with the ratchet assembly. Further, flow restriction mechanisms, such as those having a ramped, conical, or other shaped element can be used to provide additional gradations.

Additional features, such as locking or temporary holding mechanisms can be employed to control relative movement between parts of the assembly. For example, a temporary holding mechanism, such as a shear pin, shear ring, snap ring, detent, etc., can be used to maintain the piston stationary with respect to the support assembly until sufficient tubing pressure is applied to actuate the temporary holding mechanism (e.g., shear the shear pin). Further such mechanisms can be used to regulate movement of the flow restriction sleeve with respect to the support assembly or base pipe. Further, the check valve in the piston could be replaced with a flow orifice or the like, in which case the device is actuated by fluid flow rate rather than pressure.

Figure 4A:
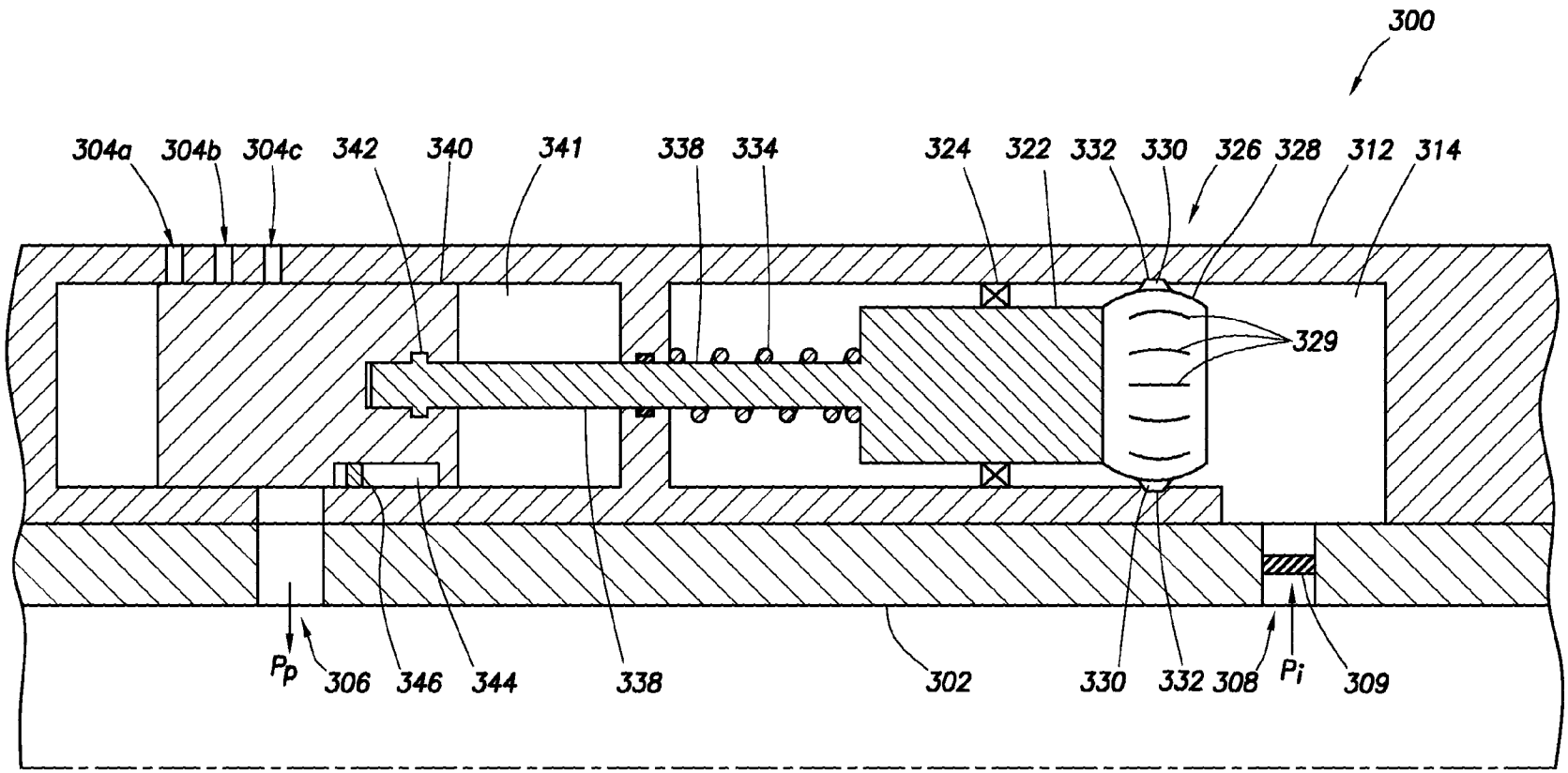
FIGS. 4A-C are schematic, cross-sectional, partial views of an exemplary embodiment of an inflow control device according to an aspect of the invention.
Figure 4B:
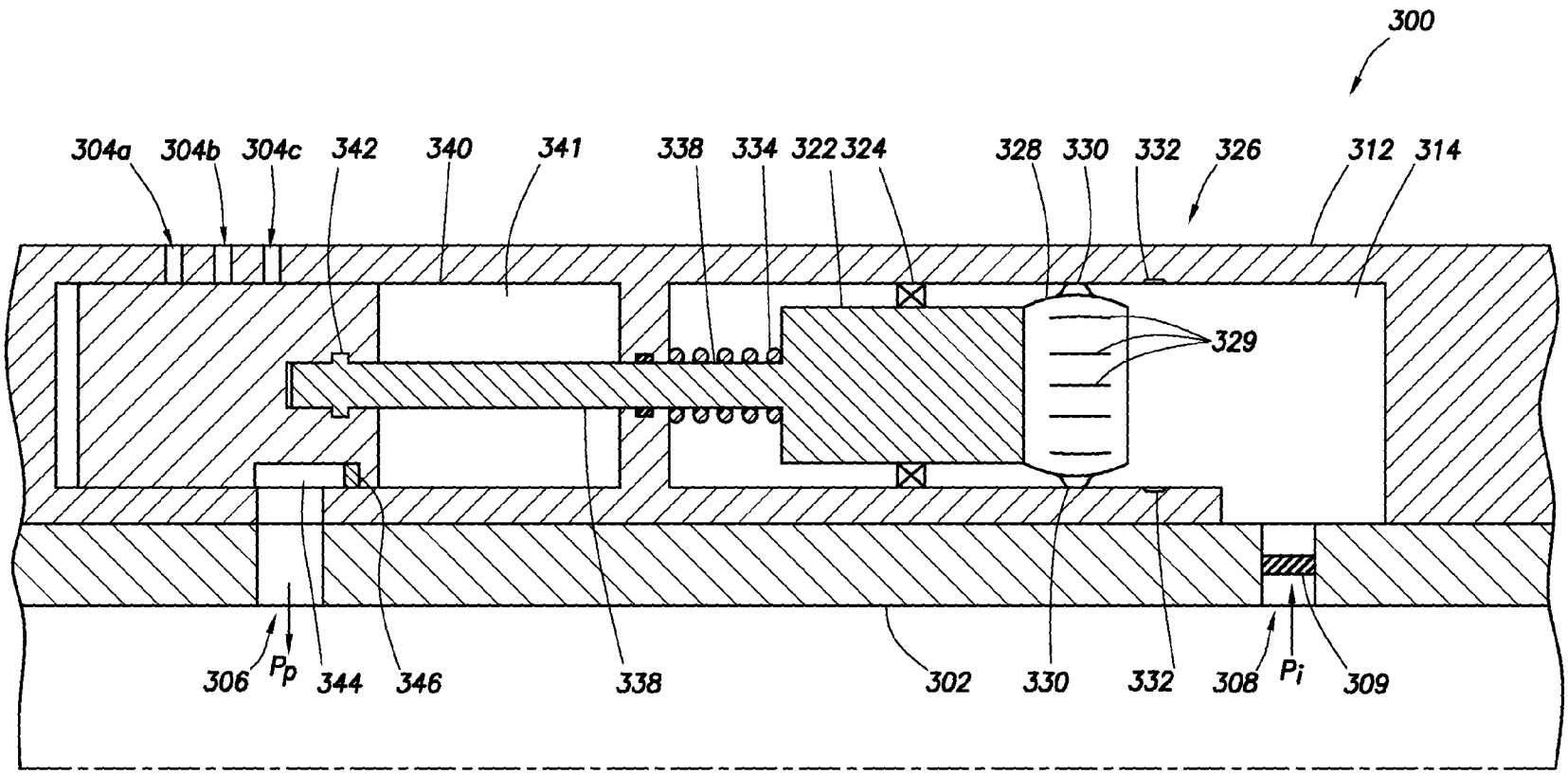
Figure 4C:
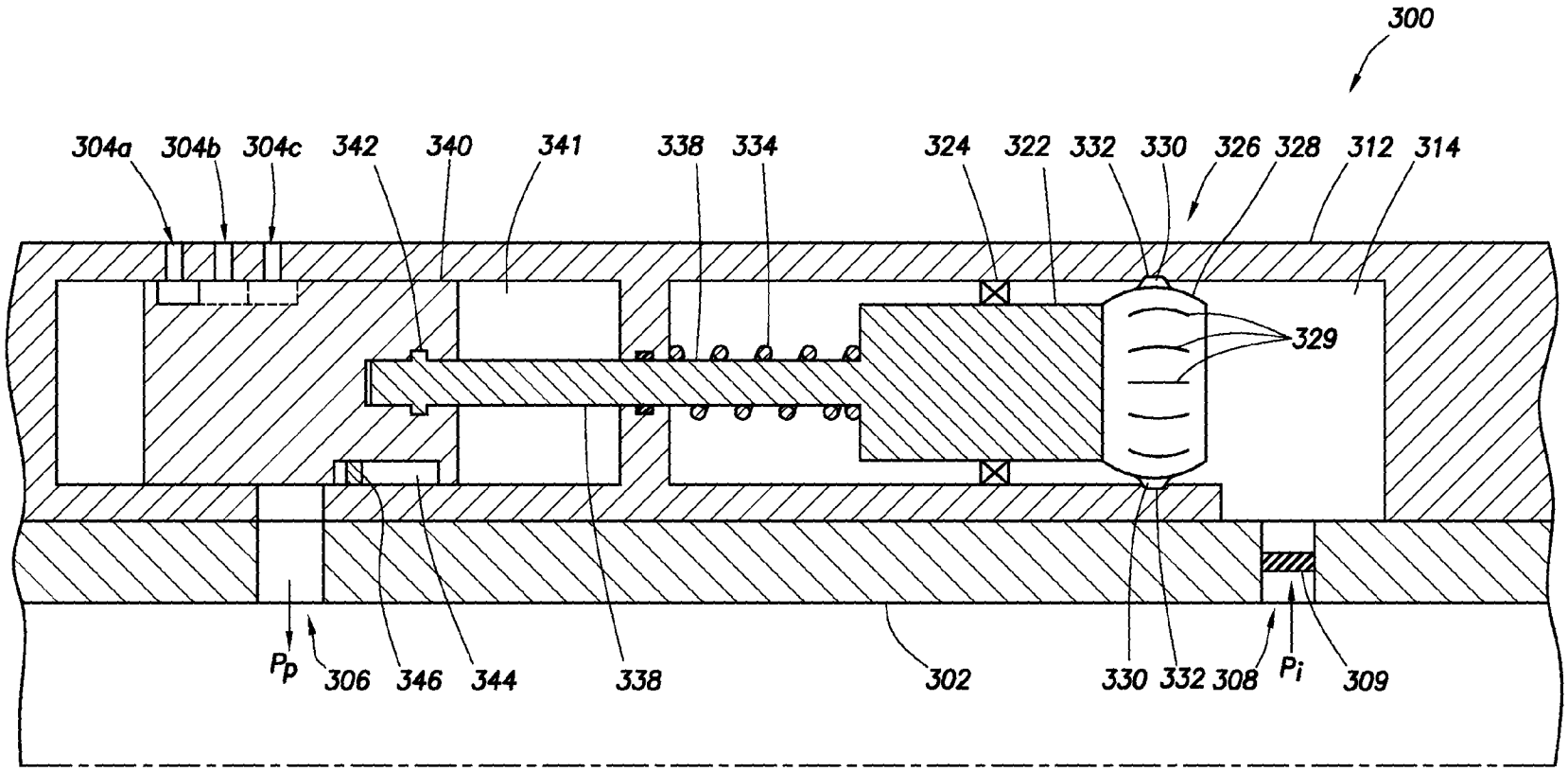

FIGS. 4A-C are schematic cross-sectional illustrations of an exemplary embodiment, generally designated as 300, of an inflow control device according to an aspect of the invention utilizing a j-slot actuated flow restriction mechanism. The illustrated inflow control device can be used with or without a screen assembly, additional flow control components etc. The embodiment described in the preferred embodiment below is simplified for purposes of discussion.

The illustrated flow control device 300 is positioned about a base pipe 302. Multiple devices can be attached to the base pipe at circumferentially spaced apart locations on the base pipe. Similarly, a single housing surrounding the base pipe can be utilized to house multiple inflow restriction devices. Other arrangements will be apparent to those of skill in the art. The base pipe includes inflow ports 306 providing fluid communication between the interior of the base pipe and the valve annulus 341. Further, the base pipe includes pressure ports 308 providing for pressure communication between the interior of the base pipe and the piston annulus 314.

The inflow control device 300 includes a slidable piston 322 positioned in a piston annulus 314 defined between in the housing 312. Seals 324 provide a fluid seal between the piston and housing walls. The piston 322 is initially, releasably, and repeatably, held in a first position by a holding device 326, as seen in FIG. 4A. In the preferred embodiment shown, the piston is held in position by a collet assembly 328 having a plurality of collet fingers 329 movable between a radially expanded position, seen in FIG. 4A, and a radially collapsed position, seen in FIG. 4B. The collet assembly includes a plurality of locking dogs 330 extending radially from the collet fingers into cooperating one or more recesses 332 defined in the housing walls. Operation of collet assemblies, as well as various designs for collet assemblies, are known in the art and will not be discussed in further detail here. The holding device can alternately be a snap ring, spring-loaded radial pin, a cooperating locking dog extending from a spring-loaded or otherwise biased element, such as a spring arm, lever arm, etc. Other embodiments will be apparent to those of skill in the art.

The piston is biased toward the first position by a biasing mechanism 334, such as a coil spring, as shown. The coil spring seats on one end of the piston and a housing shoulder 336. The coil spring is positioned around a mechanical link 338, here a simple piston rod extending longitudinally from the piston.

Changes in the pressure signal may be used to cycle a sliding valve element 340 through a plurality of positions or an infinite series of positions. As best seen in FIG. 4A, the piston rod is attached to the valve element 340 at rotation joint 342 to allow relative rotational movement of the rod and valve element. The piston is operable to longitudinally slide the valve element, back and forth, in valve annulus 341. The rotatable element 340 may include a groove 344, referred to as a j-slot, defined on its surface into which one or more pins 346 extend. The pins 346 can extend radially from the housing wall, base pipe, etc., and cooperate with the groove. Alternately, the groove can be defined on the housing or base pipe wall while the pins are carried on the valve element.

The housing 312 has a plurality of production ports 304*a-d* providing fluid communication between the valve annulus 341 and the wellbore annulus exterior to the device. These production ports cooperate with the valve element 340, which, depending on its rotational position, blocks or allows fluid flow through one or more of the production ports. The valve element may have one or more flow recesses 348 defined on its exterior surface for cooperation with the production ports 304. The valve element is rotatable to a plurality of positions, each defining a flow condition, such as closed, one-third open, two-thirds open, and fully open, for example. In the closed position, seen in FIG. 4A, the valve element blocks flow through the production ports 304. In the one-third open position, a flow recess 348 of the valve element is positioned such that flow recess 348 aligns with and allows production through, for example, production port 304*a* while the other production ports remain blocked. Further positions of the valve element allow for flow through additional production ports or combinations of production ports.

Changes in the tubing pressure signal acting on the piston 322 cause the piston to slide in the piston annulus 314. The increased tubing pressure acts on the collet assembly, radially collapsing the collet at a pre-selected pressure. Additional devices spaced along the wellbore, or spaced along an isolated length of the wellbore, are preferably all operated at the same pressure, such that all inflow control devices are operated simultaneously. The collet collapses as dogs 330 are moved from recesses 332. The piston 322 shifts longitudinally, compressing biasing spring 334. Longitudinal movement of the piston and rod cause similar longitudinal movement of the valve element 340 within valve annulus 341. Relative movement between the pins 346 and valve element cause the pin to slide within the j-slot 344. The j-slot causes the valve element to rotate about rotational joint 342.

Rotation of the valve element selectively aligns the flow recesses 348 of the valve element with one or more production ports 304*a-c*, allowing fluid flow through the ports at a pre-selected flow rate. At other rotational positions, flow is blocked through the production ports 304. The j-slot can be designed to require multiple pressure signals to rotate the valve element from a closed position to an open position. In this case, pin 346 may have to travel through several sections of j-slot 344 before the valve element is rotated to an aligned position with the ports 304. Alternatively or additionally, j-slot 344 may be used to prevent further rotation of valve element 340 once placed in a particular position, such as the fully open position. That is, the j-slot mechanism can be used to lock the valve in a position. In addition, the j-slot may enable the valve element to be configured in various choking or partial-flow positions between the closed position and the fully open position. The j-slot can be infinite, such that rotation can be caused through an infinite repetition of closed and open positions by continued pressure cycling.

The operation of the inflow control device 300 will be described with reference to FIGS. 4A-B. The device is typically run-in to the hole in a first or closed position. Flow through the production ports is prevented by the valve element. The piston 322 is also in a first position, maintained in position by biasing mechanism 334 and holding mechanism or collet assembly 326.

When it is desired to open the inflow control device, tubing pressure is increased by the operator, applying a differential pressure across the piston sufficient to collapse the collet assembly 326 and move the piston 322 longitudinally from a first position, as seen in FIG. 4A, to a second position, as seen in FIG. 4B. The collet assembly 326 collapses radially inward as dogs 330 are pulled from recesses 332. The collet assembly 328, piston 322, rod 338, and valve element 340 are all moved longitudinally along piston annulus 314 and valve annulus 341. The piston movement compresses the biasing mechanism 334.

Although the initial condition of the production ports 304 can be set by the operator, it is expected that in most applications the production ports will be in a closed position upon run-in-hole. In such a preferred embodiment, flow through across the production ports 304, valve annulus 341, and inflow ports 306 remains blocked when the piston is in the second position, seen at FIG. 4A. Note that, in such a case, increased tubing pressure will simultaneously operate a plurality of inflow control devices spaced longitudinally along the wellbore.

Tubing pressure is then lowered such that the biasing mechanism 334 forces the piston 322 back to its original or first position. The valve element 340 is pulled along longitudinally to its original or first longitudinal position, however, the valve element is rotated about its longitudinal axis by cooperation of the groove 344 and pin 346.

As the valve element is moved longitudinally, the groove 344 and pin 346 cooperate to rotate the valve element. The valve element rotates with respect to the piston rod 338 about joint 342. The j-slot track design dictates the rotational movement of the valve element in response to longitudinal movement of the piston. The j-slot track design will not be discussed in detail as such mechanisms and designs are known in the art. In a preferred embodiment, the valve element rotates, but does not open production ports 304 during an initial stroke from the first to the second position. Upon return of the piston to its original position, the track defined by the groove 344 will cause the valve element 340 to rotate during the longitudinal movement of the valve element. Note that multiple pressure sequences can be required to open the production ports as a safety measure to prevent premature or accidental opening. In a preferred embodiment, the production valve 304*a* is aligned with a corresponding fluid passageway 305*a* defined in the surface of valve element 340. The fluid passageway allows flow of fluid from production port 304*a* to the valve annulus 341. Fluid then enters the base pipe at ports 306. Thus, one tubing pressure cycle (up-down) opens production flow to a first flow level.

Additional cycles operate in a similar manner, rotating the valve element further and aligning additional production ports 304*b-c* with additional flow passageways 305*b-c*. At each successive cycle, a greater total fluid flow is allowed across the valve annulus. The flow passageways and production ports can be sized and aligned as desired. For example, all production ports can be equally sized such that opening of a second port 304*b* effectively doubles the flow from a single port 304*a*. Alternately, the production ports can be of different size, allowing different fluid flow across them. The preferred embodiment provides a production port sequence of closed, one port open, two ports open, three ports open, closed. This can be altered, obviously, to provide a different order, different number and size of ports opened, etc. For example, the sequence can call for two ports to be closed when any one port is open, additional "closed" positions can be interposed between open positions, etc.

In a preferred embodiment, the valve element can be rotated to close the production ports 304*a-c* and stop fluid flow between the base pipe interior and wellbore annulus. An endless groove 344 can be utilized to provide infinite potential opening and closing cycles of the valve. Alternately, if it is desirable to have a "final" valve element position, locking the valve open or closed, for example, the groove can employ a "dead-end" effectively preventing any further rotation.

Further, the device can optionally utilize a diaphragm 309 over the port 308. A relatively non-compressible fluid fills the piston annulus 314. While the diaphragm will transmit tubing pressure to the piston annulus 314, tubing fluids will not pass into the annulus, thereby maintaining the collet and piston assemblies clean.

The flow rate is defined by the dimensions of the production ports, fluid passageways, and inflow ports. These elements can be designed to provide the desired flow areas, flow rates, etc., based on wellbore conditions and design considerations. Further, these elements can be selected and designed based on expected wellbore fluid characteristics over the life of the well. As an example, where it is expected that an oil well will eventually yield to a greater percentage of (undesired) gas production, the valve element can be rotated to a position to reduce gas production while still optimizing oil production. Fluid control components can, for example, be defined on the surface of the valve element.

Additional features, such as locking or temporary holding mechanisms can be employed to control relative movement between parts of the assembly. For example, a temporary holding mechanism, such as a shear pin, shear ring, snap ring, detent, etc., can be used to maintain the piston or valve stationary with respect to the housing until sufficient tubing pressure is applied to actuate the temporary holding mechanism (e.g., shear the shear pin).

In the preferred and exemplary methods presented herein and in the appended claims, various method steps are disclosed, where the steps listed are not exclusive, can sometimes be skipped, or performed simultaneously, sequentially, or in varying or alternate orders with other steps (i.e., steps XYZ can be performed as XZY, YXZ, YZX, ZXY, etc.) (unless otherwise indicated), and wherein the order and performance of the steps is disclosed additionally by the claims appended hereto, which are incorporated by reference in their entirety into this specification for all purposes (including support of the claims) and/or which form a part of this specification, the method steps presented in the following text. Exemplary methods of use of the invention are described, with the understanding that the invention is determined and limited only by the claims. Those of skill in the art will recognize additional steps, different order of steps, and that not all steps need be performed to practice the inventive methods described.

While this invention has been described with reference to illustrative embodiments, this description is not intended to be construed in a limiting sense. Various modifications and combinations of the illustrative embodiments as well as other embodiments of the invention, will be apparent to person skilled in the art upon reference to the description. It is, therefore, intended that the appended claims encompass any such modifications or embodiments.

It is claimed:

1. A downhole fluid flow control system operable to be positioned in a wellbore extending through a subterranean formation and operable to control fluid flow between the wellbore and an internal passageway of a tubular, the system comprising:

a tubing-pressure operated device positioned along a flow path between the interior passageway of the tubular and the exterior of the tubular;

a piston element, biased towards a first position, slidably disposed in a piston annulus, the piston annulus having a pressure-transmitting port to the interior passageway of the tubular, the piston element movable to a second position responsive to a tubing-pressure change transmitted through the pressure-transmitting port; and a valve element releasably attached to the piston element and movable in response to movement of the piston element between a closed position wherein fluid flow is blocked across the flow path and an open position wherein flow is allowed across the flow path, wherein the flow path passes through a bypass port defined in the piston element.

2. The system of claim 1, wherein the piston element further includes a check valve positioned thereon operable to control fluid flow through the bypass port.

3. The system of claim 1, wherein the flow path passes through the piston annulus.

4. The system of claim 1, wherein the valve element is movable to multiple open positions, each open position allowing fluid flow across a pre-selected flow area.

5. The system of claim 4, wherein the valve element is stepped, ramped, conical, partially conical or otherwise shaped to define the multiple open positions.

6. The system of claim 1, wherein the valve element and piston element include cooperating one-way ratchet teeth.

7. The system of claim 6, wherein the piston element further includes a slip, the one-way ratchet teeth defined thereon.

8. The system of claim 1, wherein the valve element is a rotational valve element.

9. The system of claim 8, further comprising a j-slot mechanism for controlling rotational movement of the valve element.

10. The system of claim 9, wherein the j-slot mechanism includes a pin and cooperating groove in which the pin travels relative to the rotational valve element.

11. The system of claim 10, wherein the groove is defined on the surface of the rotational valve element and wherein the pin extends radially into the valve annulus.

12. The system of claim 10, wherein the groove is endless.

13. The system of claim 8, wherein the rotational valve element is rotatable to multiple open positions relative to a cooperating multiple of production ports.

14. The system of claim 8, wherein the rotational valve element can be rotated from a closed position to an open position and then to a closed position.

15. The system of claim 1, further comprising a temporary holding mechanism operatively connected to the piston element.

16. The system of claim 15, wherein the temporary holding mechanism can be repeatedly used.

17. The system of claim 1, wherein the piston element is an annular piston element having a longitudinal axis coincident with the longitudinal axis of the tubular.

18. The system of claim 1, wherein the piston element is biased towards the first position with a biasing mechanism and wherein the piston element is movable to the second position responsive to the tubing-pressure change transmitted through the pressure-transmitting port overcoming the biasing mechanism.

19. A method for servicing a subterranean wellbore extending through a formation, the method comprising the steps of:

a) positioning at a downhole location a wellbore tubular having a flow control device positioned thereon, the flow control device having a piston element mounted for longitudinal movement within a piston annulus and biased towards a first position, a valve element mounted for movement and operable by the piston element, and defining a flow path between an interior passageway of the wellbore tubular and the wellbore annulus, the valve element positioned along the flow path and operable to selectively block or allow fluid flow along the flow path;

b) increasing tubing pressure;

c) moving the piston longitudinally in response to step b) from the first position to a second position;

d) decreasing tubing pressure;

e) moving the piston longitudinally in response to step d) from the second position to the first position;

f) moving the valve element and releasably attaching the piston element and the valve element to one another in response to step c);

g) allowing fluid flow along the fluid flow path in response to step f);

(h) sealing a check valve positioned on the piston element in response to step b), thereby blocking fluid flow through a bypass port defined in the piston element.

20. The method of claim 19, wherein the step of releasably attaching the piston and valve elements further comprises the step of interlocking cooperating one-way ratchet teeth defined on the valve element with corresponding ratchet teeth defined on the piston element.

21. The method of claim 19, wherein the step of interlocking includes moving a toothed slip into cooperating contact with ratchet teeth of the valve element.

22. The method of claim 19, further comprising the steps of:

cyclically increasing and decreasing tubing pressure;

repeatedly moving the piston element in response thereto;

repeatedly moving the valve element, in response to movement of the piston element, between a closed position and multiple open positions, each open position allowing a different fluid flow rate across the valve element.

23. The method of claim 22, further comprising the steps of repeatedly attaching and detaching the piston element and valve element to one another in response to the repeated movement of the piston element.

24. The method of claim 19, wherein step f) further comprises the step of rotating the valve element.

25. The method of claim 24, wherein the valve element is operable by relative movement between a pin and a groove.

26. The method of claim 24, wherein the valve element is rotatable between a closed position and at least two open positions, each open position allowing a different flow rate through the device.

27. The method of claim 26, wherein the rotating valve is endlessly rotatable.

* * * * *